US011577536B2

(12) United States Patent
Xu et al.

(10) Patent No.: US 11,577,536 B2
(45) Date of Patent: Feb. 14, 2023

(54) IMAGE RECEIVER MEDIA AND IMAGING PROCESS

(71) Applicants: Ming Xu, Malvern, PA (US); Dimple Patel, Mt. Pleasant, SC (US); Alexander Tokarev, Mt. Pleasant, SC (US)

(72) Inventors: Ming Xu, Malvern, PA (US); Dimple Patel, Mt. Pleasant, SC (US); Alexander Tokarev, Mt. Pleasant, SC (US)

( * ) Notice: Subject to any disclaimer, the term of this patent is extended or adjusted under 35 U.S.C. 154(b) by 165 days.

(21) Appl. No.: 17/189,686

(22) Filed: Mar. 2, 2021

(65) Prior Publication Data

US 2021/0268820 A1 Sep. 2, 2021

Related U.S. Application Data

(60) Provisional application No. 62/983,836, filed on Mar. 2, 2020.

(51) Int. Cl.

| | |
|---|---|
| ***B41M 5/035*** | (2006.01) |
| ***B41J 29/36*** | (2006.01) |
| ***B41M 5/00*** | (2006.01) |
| *B41J 2/01* | (2006.01) |
| *B41M 5/44* | (2006.01) |

(52) U.S. Cl.

CPC ..... *B41M 5/035* (2013.01); *B41J 29/36* (2013.01); *B41M 5/00* (2013.01); *B41M 5/0356* (2013.01); *B41J 2/01* (2013.01); *B41M 5/44* (2013.01)

(58) Field of Classification Search

CPC ..... B41M 5/035; B41M 5/00; B41M 5/0356; B41M 5/44; B41J 29/36; B41J 2/01

See application file for complete search history.

(56) References Cited

U.S. PATENT DOCUMENTS

| | | | | |
|---|---|---|---|---|
| 5,210,068 | A | 5/1993 | Egashira et al. | |
| 5,644,988 | A | 7/1997 | Xu et al. | |
| 6,486,903 | B1 | 11/2002 | Wagner et al. | |
| 6,540,345 | B1 | 4/2003 | Wagner et al. | |
| 6,824,839 | B1 * | 11/2004 | Popat | B41M 3/006 428/32.25 |

(Continued)

FOREIGN PATENT DOCUMENTS

| | | |
|---|---|---|
| CA | 1275009 | 9/1987 |
| CA | 2785024 | 12/2010 |

(Continued)

OTHER PUBLICATIONS

Harald Johnson, Mastering Digital Printing, 2005, Second Edition, Stacey L. Hiquet, USA.

*Primary Examiner* — Yaovi M Ameh

(74) *Attorney, Agent, or Firm* — B. Craig Killough

(57) ABSTRACT

An image is formed on a transfer medium comprising a hydrophilic tackifier. Any portion of the image that is dimensionally insufficient to permanently adhere the image to the receiver substrate is determined, and a colorless liquid ink comprising water is applied to cover and surround the portion of the image that is dimensionally insufficient to permanently adhere the image to the receiver substrate. When heat is applied to the image to transfer the image layer to a receiver substrate, water in the image layer swells the image layer and the hydrophilic tackifier becomes sufficiently tacky to permanently adhere the image to the receiver substrate.

14 Claims, 8 Drawing Sheets

(56) References Cited

U.S. PATENT DOCUMENTS

| | | | | |
|---|---|---|---|---|
| 6,832,832 | B2 | 12/2004 | Martin et al. | |
| 6,840,614 | B2 | 1/2005 | Wagner et al. | |
| 6,964,722 | B2 | 11/2005 | Taylor et al. | |
| 7,001,649 | B2 | 2/2006 | Wagner et al. | |
| 7,381,443 | B2 | 6/2008 | Konno et al. | |
| 7,662,451 | B2 | 2/2010 | deVisser et al. | |
| 8,029,883 | B2 | 10/2011 | Xu et al. | |
| 8,398,224 | B2 | 3/2013 | Hale et al. | |
| 8,625,162 | B2 | 1/2014 | Yasuoka et al. | |
| 8,735,320 | B2 | 5/2014 | LaCosta | |
| 9,139,747 | B2 | 9/2015 | Kamada | |
| 9,399,362 | B1 | 7/2016 | Cobb, III | |
| 10,414,154 | B2 | 9/2019 | Alfekri et al. | |
| 10,507,643 | B2 | 12/2019 | Ozawa | |
| 2007/0172609 | A1* | 7/2007 | Williams | B41M 5/44 428/32.51 |
| 2007/0181253 | A1 | 8/2007 | Xu et al. | |

FOREIGN PATENT DOCUMENTS

| | | | | | |
|---|---|---|---|---|---|
| CN | 109937242 | | | 10/2016 | |
| CN | 112030579 | | | 8/2020 | |
| EP | 0370007 | B1 | | 10/1994 | |
| EP | 1833680 | | | 3/2005 | |
| JP | 3015795 | B1 | | 3/2000 | |
| JP | 2003154715 | A | | 11/2001 | |
| JP | 3502441 | B2 | | 3/2004 | |
| JP | 3957753 | B2 | | 5/2007 | |
| JP | 2012143873 | A | * | 8/2012 | B41J 29/36 |
| KR | 20160132476 | | | 4/2014 | |
| MX | 2013014848 | A | | 12/2013 | |
| NL | 2008066 | C2 | | 7/2013 | |
| WO | WO2008040992 | | | 4/2008 | |
| WO | WO-2008040992 | A1 | * | 4/2008 | B44C 1/17 |
| WO | WO2008101115 | A1 | | 8/2008 | |
| WO | WO2020074663 | | | 4/2020 | |

* cited by examiner

IMAGE RECEIVER MEDIA AND IMAGING PROCESS

Applicant claims priority of Provisional Application Ser. No. 62/983,836, filed Mar. 2, 2020.

BACKGROUND OF THE INVENTION

Transfer imaging processes involve physically transferring an image to a substrate, or transferring an image from one substrate to another. Transfer media are receivers for printed images from which the image is subsequently transferred. Transfer media are commonly rectangular sheets in sizes such as A and A4 upon which one or more materials are coated. The transfer media may include a release layer that encourages release of the image to the receiver substrate during transfer. The materials coated on the transfer media may be binder materials that bond the image to the final receiver substrate upon which the image is to appear.

Sublimation transfer technologies are widely used in digital imaging applications. However, these applications are limited to receiver substrates that comprise a synthetic component, such as polyester materials. Due to the characteristics of the sublimation colorants, full color sublimation transfer technology has been mainly used for white or pastel substrates. Further, sublimation printing processes require relatively low to medium energy sublimation colorants. Color fastness properties, especially light fastness, have been an issue for these applications.

With known direct transfer media, the entire transfer or release coating, whether or not imaged, is indiscriminately transferred onto the final receiver substrate. Such indiscriminative transfer creates an undesirable "hand and feel" and produces an undesirable appearance, especially when the non-imaged areas of the receiver substrate suffer inconsistent color changes due to chemical changes or physical deposition. The problems exist with receiver substrates, whether the substrate is white, pastel or dark in color.

Attempts have been made to image dark substrates, such as dark colored textile materials. For instance, peelable white transfer papers have been used in combination with sublimation inks. This imaging method requires a relatively thick coating structure in order to allow mechanical separation of transfer film from the supporting paper. The thick structure creates a heavy, and undesirable, 'hand' on textile substrates. In addition, the film peeled from a supporting paper after imaging the film may become dimensionally unstable, resulting in image distortion.

Sublimation printing with other forms of white transfer paper has also been used to image dark textiles. However, the use of large amounts of white pigment in the transfer layers, with the binders having a high affinity to sublimation dyes, yields poor penetration and transfer efficiency, as well as low image resolution by excessive ink dot-gain, making the final product undesirable for apparel and delicate textiles when high quality or photographic quality images are required. The spread of sublimation dyes through all pigmented layers consumes an undesirably large amount of colorant.

SUMMARY OF THE INVENTION

The present invention is directed to a novel transfer method for use with images formed on media by inks or toners comprising thermally diffusible colorants. A transfer medium comprising an ink activatable coating material is used with intelligent software that controls the quantity of ink discharge and the dimensions of the ink discharge on the transfer medium substrate. During the transfer step, the image is transferred from the transfer medium to the receiver substrate with only the desired portion of the imaged area transferred from the coated transfer medium to the receiver substrate. The imaged portion of the transfer medium is transferred, and the non-imaged portion of the transfer medium is not transferred.

An image is formed on a transfer medium comprising a hydrophilic tackifier. Any portion of the image that is dimensionally insufficient to permanently adhere the image to the receiver substrate is determined, and a colorless liquid ink comprising water is applied to cover and surround the portion of the image that is dimensionally insufficient to permanently adhere the image to the receiver substrate. When heat is applied to the image to transfer the image layer to a receiver substrate, water in the image layer swells the image layer and the hydrophilic tackifier becomes sufficiently tacky to permanently adhere the image to the receiver substrate.

Thermally diffusible colorants, such as disperse and sublimation dyes, including high lightfastness disperse dyes, may be used. The colorants are printed or applied on one side of the transfer medium, along with a colorless 'enhancer' ink, and upon transfer process, thermally diffused and migrated through the ink-activatable coating material to form a satisfactory image. Upon transfer of the image, the dyes are fixed to a polymeric material for which the dyes have a high affinity. Dithering-control software ensures that a sufficient quantity of ink is placed dimensionally to form the image and activate the coating material of the transfer medium to properly bond the image to the receiver substrate.

DESCRIPTIONS OF PREFERRED EMBODIMENTS

Figure 3A:
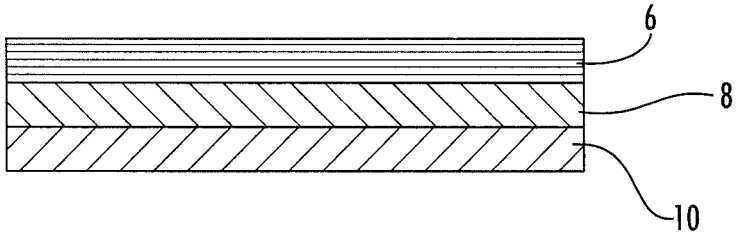
FIG. 3*a* shows layers of a transfer medium according to the invention.

In one embodiment of the present invention, a transfer medium comprises a base sheet 10, a release layer 8, and an ink receptive layer 6 containing clear polymeric material having a strong affinity for thermally diffusible colorants and a hydrophilic tackifier agent. FIG. 3*a*.

Figure 3B:
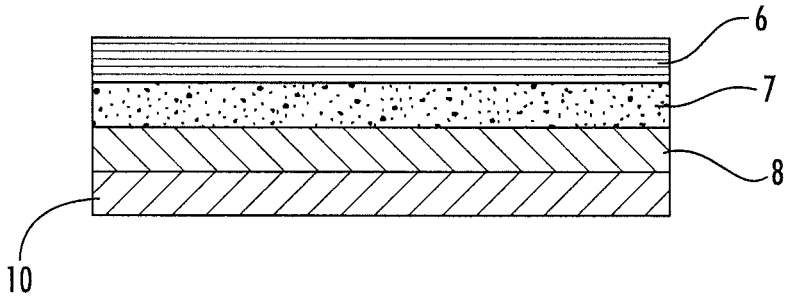
FIG. 3*b* shows layers of another embodiment of the transfer medium.

In another embodiment of the present invention, the transfer medium comprises a base sheet 10, a release layer 8, a clear polymer layer 7 having a strong affinity for thermally diffusible colorants, and an ink receptive layer 6 comprising a hydrophilic tackifier agent. FIG. 3*b*.

Figure 4:
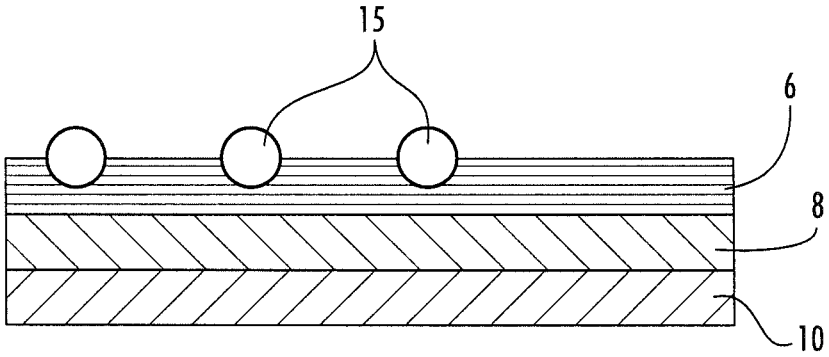
FIG. 4 depicts a transfer medium imaged with ink dithering at the ink receptive layer.

Inks that may be used with the invention are color liquid inks, such as an ink jet ink described in Hale et al, U.S. Pat. No. 5,488,907. At least one colorless 'enhancer' ink may be liquid ink with a similar composition to that of the color liquid ink, but without thermally diffusible colorants. Applied alone or in combination, the color inks and the colorless enhancer ink form the transferable image 15 formed on the transfer medium of FIG. 3*a* and depicted in FIG. 4.

Figure 5:
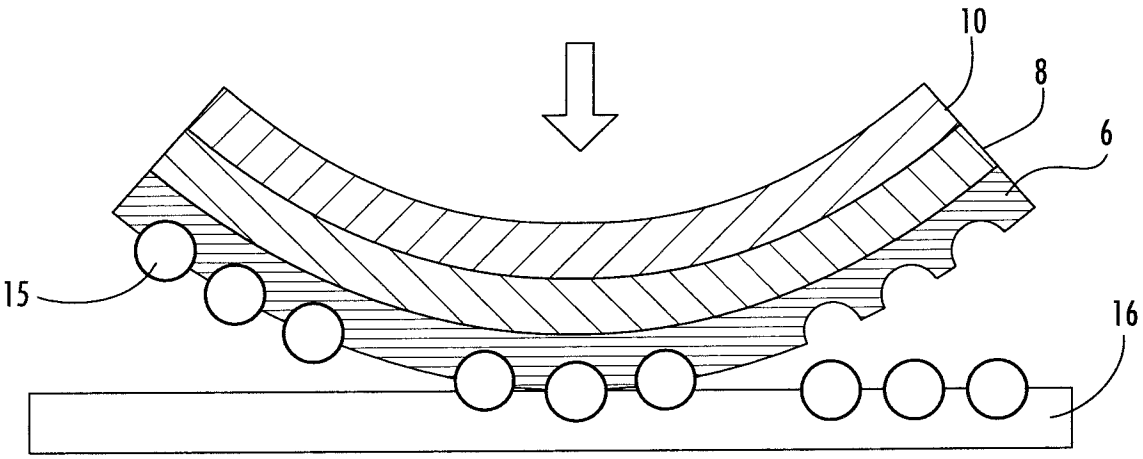
FIG. 5 illustrates the image transfer process with only the imaged portion of the ink receptive layer transferred to the receiver substrate.

In yet another embodiment of the present invention, an image is printed or otherwise applied or formed on a transfer medium with a color ink or inks. Next, a colorless 'enhancer' ink is applied to compensate for inadequate ink coverage and/or to enhance the ink quantity to achieve an efficacious layer thickness for image transfer. The portion of the transfer medium that is imaged with liquid inks becomes swelled, raised and tacky. The portion or portions of the imaged area may either be contiguous, dithered or discrete, depending upon the image that is formed. The non-imaged area, however, remains unchanged. Upon application of heat and/or pressure to the back of the transfer medium, the coating materials of the imaged areas 15 that are present on the transfer medium are transferred to the final or receiver substrate 16. The portions of ink receptive layer 6 that are not imaged are not transferred to the final receiver substrate. FIG. 5.

In use according to one example, an image 15 is printed on the transfer medium opposite the base sheet 10. An optional release layer 8 may be present. The image may be printed by a digital printer, such as a computer 20 driven ink jet printer 24. After the image is printed on the transfer medium, with or without the colorless 'enhancer' ink applied, the image is ready for transfer from the transfer medium to the receiver substrate 16 upon which the image will permanently appear.

Heat may be applied from the back, or base sheet 10, of the transfer medium, with intimate contact of the transfer medium with the receiver substrate 16, and preferably under pressure, to transfer the image 15 from the transfer medium to a receiver substrate. (FIG. 5) The heat may simultaneously activate the colorants that form the image, and/or react components and bond and/or cross-link the final receiver substrate and the colorants. The image is fixed to the receiver substrate, providing excellent durability and fastness properties for the image that is applied to final receiver substrate according to the imaging process. Appropriate pressure is applied during the transfer process to ensure the proper intimate interfacial contact between the image transfer medium and the final receiver substrate. In some applications, vacuum may be applied during the transfer process to enhance transfer efficiency.

The ink receptive layer 6 may comprise at least one hydrophilic tackifier that absorbs hydrophilic solvents such as water, alcohol, glycol, water soluble and water miscible solvents with a hydroxyl group in chemical structures. Upon absorbing hydrophilic solvents, the hydrophilic tackifier becomes swelled, tacky or sticky, and raised slightly from the transfer medium, allowing a higher degree of contact with the final receiver substrate to be imaged.

Hydrophilic tackifier agent materials suitable for the present invention include organic or inorganic materials, natural or synthetic materials, and most commonly, polymeric materials. Hydrophilic tackifier may be used in the coating formulation that forms the ink receptive layer 6. Multiple hydrophilic tackifiers may be blended according to the application to achieve the desired level of performance.

Natural or modified natural hydrophilic tackifiers that may be used depending on the application include polysaccharide and its derivatives, including gum Arabic, tragacanthin, polygalactose, guar gum type botanical glues, locust bean gum, karaya gum, carrageenan, pectin, agar, mamelo, seaweed polymer, starch, glycyrrhizic acid, microbial polymers such as tricyon, dextran, amber sterol, and amylopectin, carboxymethyl starch-based polymer, methyl hydroxypropyl starch, methyl cellulose, nitrocellulose, ethyl cellulose, hydroxyethyl cellulose, sodium carboxymethylcellulose (CMC), crystalline cellulose, alginic acid polymeric materials such as sodium alginate or propylene glycol alginate.

Synthetic or synthetic hydrophilic tackifiers that may be used depending on the application include polyacrylamide compound, homo-, co- and/or crosslinked acrylic acid/acrylate polymeric compounds or their corresponding salts, polypropylene dicylamine compound, and the like. Products with commercial trademarks that may be used include Encor® resin from Arkema®, Sylvares™ Aquatac™ from Kraton®, stabilized rosin ester polymeric material Snowtack™ from Lawter™, synthetic acrylic and/or carboxylated styrene butadiene such as Tacolyn™ from Eastman® Chemicals, Aristoflex™ AVC and Hostacerin™ AMPS from Clariant Co., Simulgel™ EG and Sepigel™ from Sepic® Corporation, etc.

Inorganic hydrophilic tackifiers may be used alone or in combination with organic or polymeric hydrophilic tackifying agents. Examples include, but are not limited to, laponite, lithium bentonite, phthalic anhydride.

Preferably, the softening point of the hydrophilic tackifier compound is between 10° C. and 200° C., and more preferably, the softening point is above 150° C. It is important that the resins used, either alone or in combination with each other, are colorless or nearly colorless. Preferably, the color according to the Gardner scale is between 2 and 5 using the ACQCM 002 color standard.

Other coating additives or materials may be included in the formulation of the ink receptive layer 6, such as binders. Binders may include crosslinkable polymeric binders, crosslinker, anti-sticking or releasing agents, surface electrostatic control agent, hydrophilic and/or hydrophobic swelling agents or hydrophilic polymeric crosslinking agents, fillers of either inorganic or polymeric, polymeric material with affinity to thermally diffusible colorants, and the like. Additives such as a foaming/blowing agent or agents may also be added. These foaming/blowing agents generate micropores during the heat transfer process, further allowing diffusion and migration of the colorants through the coating of the ink receptive layer from the front to the back, which is the top surface upon completion of the image transfer. Superabsorbent powder or superabsorbent polymer (SAP) powder, particle, or fibrous materials of different centrifuge retention capacity (CRC), such as polyacrylates or their salts, clay platelets with various surface modification or conditioning, may also be used in part as part of the hydrophilic tackifier agent components or additives for the receptive layer. In some applications these materials may enhance the liquid retaining properties or extend the swelling properties of the coating of the ink receptive layer. Depending on the formulation of the liquid ink, a lesser amount of hydrophobic tackifier may also be used as an additive, in comparison with hydrophilic component.

The formulation for the ink receptive layer 6 may be applied over the release layer 8 of base sheet 10 by known methods such as aqueous-based coating, solvent-based coating, hot melt coating, extruded, transfer coating, or lamination. The dry coat weight of the ink receptive layer 6 may range from 5-60 g/m2, and is preferably 10-30 g/m2.

The release layer 8 on the base sheet 10 preferably provides a surface that will promote release of, or picking away of, imaged portions of the coating material that are on the ink receptive layer 6 upon transfer of the image 15 to a receiver substrate. The base sheet may be a nonwoven cellulosic sheet or polymer film such as polyolefin, or polyester film, for example, to which may be added an acrylic or silicone coated releasing materials. Depending on the specific material used as the releasing agent, the dry coat weight of the release layer may range from 2 to 20 g/m2, and preferably less than 10 g/m2. A base sheet coated with a release layer is commercially available.

A clear polymer layer 7 in the embodiment demonstrated by FIG. 3*b* may be incorporated to further increase color vividness of the image. The clear polymer layer is a polymer layer, which has high affinity to the thermally diffusible colorants that may be used in the ink or toner to generate images. One example is polyester, which is an excellent receptor for disperse and sublimation dyes. In order to achieve flexibility of the final image and soft hand, the overall glass transition temperature of the polymeric material(s), Tg, is preferably within a range of −20° C. to 100° C. The polymer may be polyester, polyamide, acrylic/acrylate, nylon, or other receptive polymer with a high affinity for thermally diffusible colorants, or a combination thereof. The polymers may be a mixture of cross-linkable polymers. For example, a blocked polyisocyanate and a hydroxyl-functionalized polyester resin may be combined with a hot melt adhesive to form polymer layer 7. Upon application of heat during the transfer process, the polyisocyanate and hydroxyl-functionalized polyester, in the imaged portions, cross-link to form a permanently bonded color image on the receiver substrate. The polymer layer 7 may be applied on top of the release layer 8 of base sheet 10 by methods such as aqueous-based coating, solvent-based coating, hot melt coating, extruded, transfer coating, or lamination. The dry coat weight of the polymer layer 7 may range from 5-60 g/m2, and is preferably 10-30 g/m2.

| Dry Component Example of Ink Receptive Layer 6: | |
|---|---|
| Hydrophilic Tackifier Agent | 10-65% |
| Binders | 5-50% |
| Coating Additives and fillers | 5-35% |
| **Dry Component Example of Clear Polymer Layer 7:** | |
| Rucote ® thermosetting polyester resin | 0-50% |
| Hot melt adhesive | 0-50% |
| Rhodocoat WT-1000 blocked polyisocyanate | 0-15% |
| White colorant/pigment | 0-45% |
| Coating Additives | 0-20% |

The method of the invention uses at least one color of ink having thermally diffusible colorants, including but not limited to, disperse dyes or sublimation colorants. Fluorescent thermally diffusible colorants may be used alone or with other thermally diffusible colorants. The inks may be aqueous liquid inks, such as ink jet inks described in U.S. Pat. Nos. 5,488,907 and 8,632,175. Preferably, at least one ink set with three colors of inks of Cyan (C), Magenta (M), and Yellow (Y) are used for the generating of process color. An ink set with Cyan, Magenta, Yellow and Black (K) colors of ink provides useful printing speed and image color intensity. The hydrophilic components in preferred inks include water, alcohols, glycols, various diols, polyol, thios, amine or polyamine, and water soluble cosolvents. Water miscible solvents, flow additives, physical property adjustment chemicals, dispersant, surfactants, viscosity control agents, humectants, and the like may also be used. At least one colorless 'enhancer' ink is preferred to be included according to an objective of the present invention.

Inkjet ink is used in digital printing to form images using a dithering method, where minute ink droplets are discharged and displaced on the surface of the transfer medium. Full color images with multiple colors comprises hundreds to billions of small ink droplets. In lighter colored portions of the image, small amounts of ink of different colors may be used. When the color ink amounts are sufficiently high to produce a color image but are insufficient to produce a fully tackified image on the ink receptive layer with hydrophilic tackifier agent, a colorless 'enhancer' ink is used to increase the aggregate ink quantity, yielding a tackified image portion that is satisfactory for transferring the image to the final receiver substrate.

Colorless liquid, or 'enhancer,' ink used in the present invention comprises a similar chemical composition as the ink comprising colorants. The "enhancer" ink may comprise water, alcohols, glycols, and other components described above, but preferably contains no thermally diffusible colorants, or the level of colorants is sufficiently low such that the colorant is not visible with the naked eye after application of the colorless ink to the image. In order to maintain fluid dynamic flow characteristics that are similar to those of color ink, such as flow speed, droplet forming shape, and jetting behavior, and substrate impact properties such as dot gain size, etc., it is preferred, in addition to the chemical composition similarity, that the colorless 'enhancer' ink has same or similar physical properties, including viscosity, viscoelasticity, specific gravity, surface tension, pH value/alkalinity, and evaporation speed as the color ink. These properties reduce ink mottling during the imaging process. Preferably, the physical property differences between the color ink and the "enhancer" ink should be no more than 30%, and most preferably less than 5%.

| Example Ink Composition: | |
|---|---|
| Colorant | 0-30% |
| Water-soluble Co-solvent/Humectants | 5-50% |
| Biocide | 0.05-1% |
| pH Control agent | 0.1-0.5% |
| Surfactant | 0.1-15% |
| Other Physical Property Adjustment Additives | 5-35% |
| De-ionized Water | Balance |

The colorant is preferably 0%, or substantially absent, when the colorless liquid ink is prepared according to of the Example.

A software driver capable of tracing the color image ensures that a sufficient amount of ink of all colors, plus the colorless 'enhancer' ink, is applied to activate the hydrophilic tackifier agent. When a discretely produced dither or image portion is too small, or is below the required activation quantity, or when the amount of ink used in one specific imaged area is too low, the activated hydrophilic tackifier quantity is too small to transfer the image. The algorithm detects the characteristics, and applies colorless 'enhancer' ink to the image to provide sufficient adhesive between the tackified portion and the final receiver substrate so that the cohesive forces among neighboring coating materials allows the imaged portion to break out from the transfer medium.

Figure 6:
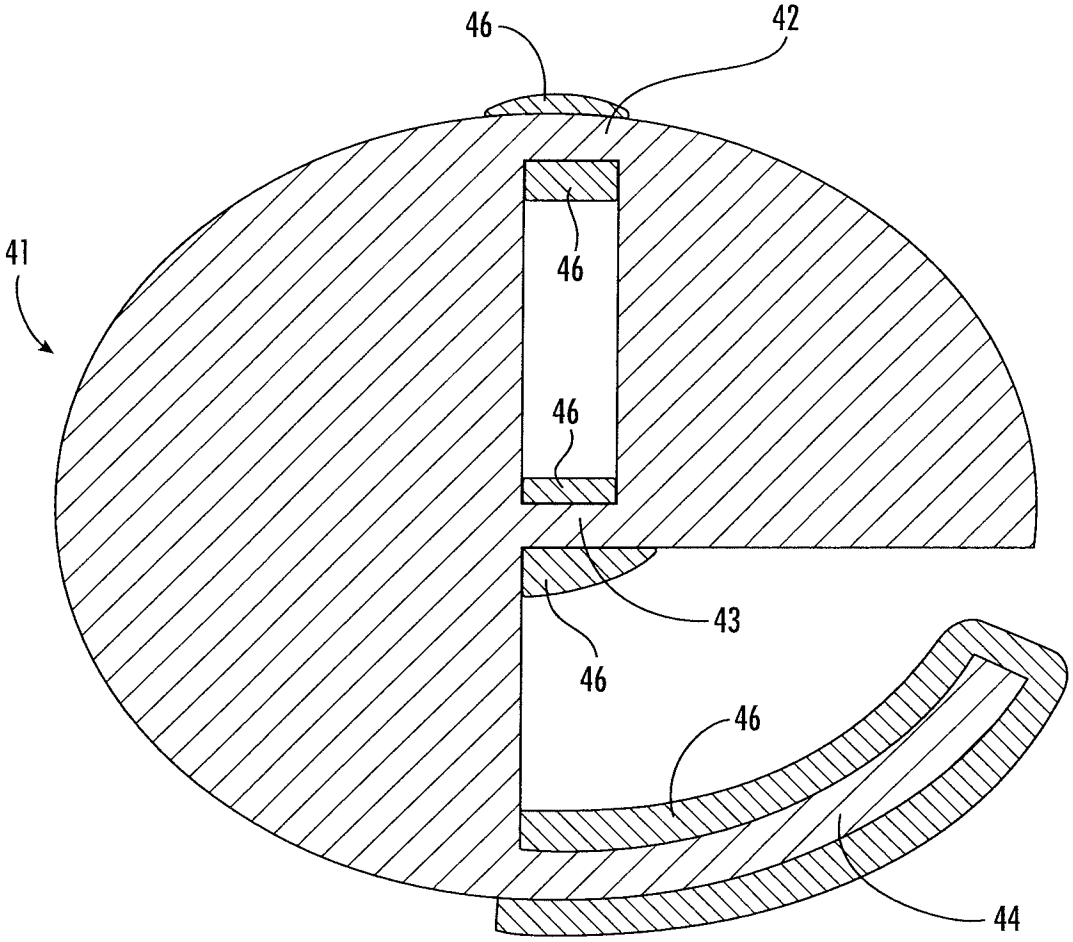
FIG. 6 demonstrates the 'enhancer' ink compensating for image details with dimensional expansion.
Figure 8:
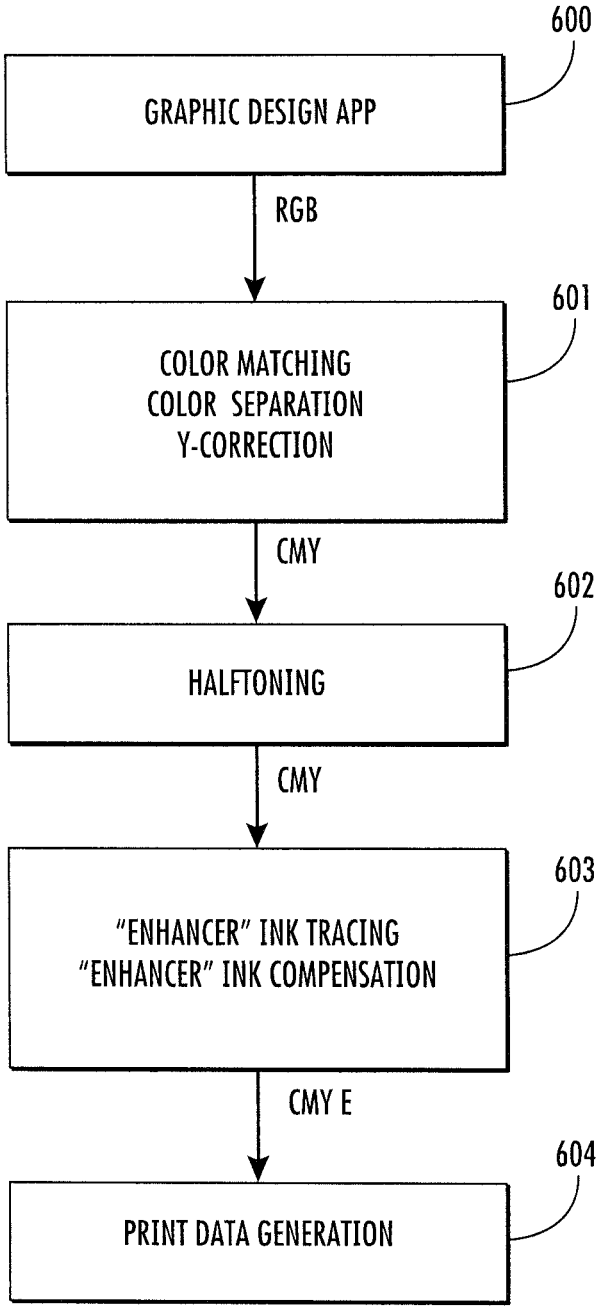
FIG. 8 is a flow chart showing steps of a four-channel color printing process incorporating a colorless 'enhancer' ink.

In FIG. 6, example image 41 of letter "e" in Martinique font, comprises relatively large continuous portions, but also has "slimmer" or smaller portions 42, 43, 44. The image of FIG. 6 is significantly enlarged for the purpose of this example. In use, the font size will typically be substantially smaller. When one or more slimmer portions of an image have dimensions that are less than approximately three times the coating layer thickness associated with the image, the coating material will not break apart. The smaller portions of the image are dimensionally insufficient to permanently adhere the image to the receiver substrate upon transfer of the image. Stated otherwise, image portions 42, 43, 44 will not satisfactorily transfer from the transfer medium to the final receiver substrate by the heat transfer process without an application of the colorless 'enhancer' ink since those portions of the image are dimensionally insufficient to permanently adhere the image to the receiver substrate. By way of example, an imaged layer of 25 microns in thickness may require a minimum dimension of about 75 microns in all directions along the x-y plane of the transfer medium to adequately transfer. If any dimension of 42, 43, 44 is less than the 75 micron dimension of the visible image, the colorless 'enhancer' ink is deposited to surround and cover the visible color ink of the image to achieve the minimum dimensional requirements. FIG. 6. Preferably, the colorless 'enhancer' ink is deposited on the transfer medium through a colorless 'enhancer' ink channel of a printer controlled by a digital imaging device driver or RIP (Rastering Image Processor). The level of tracing and quantity of compensation of using the colorless 'enhancer' ink occur at the image rendering stage before the image is printed. (FIG. 8)

Figure 7:
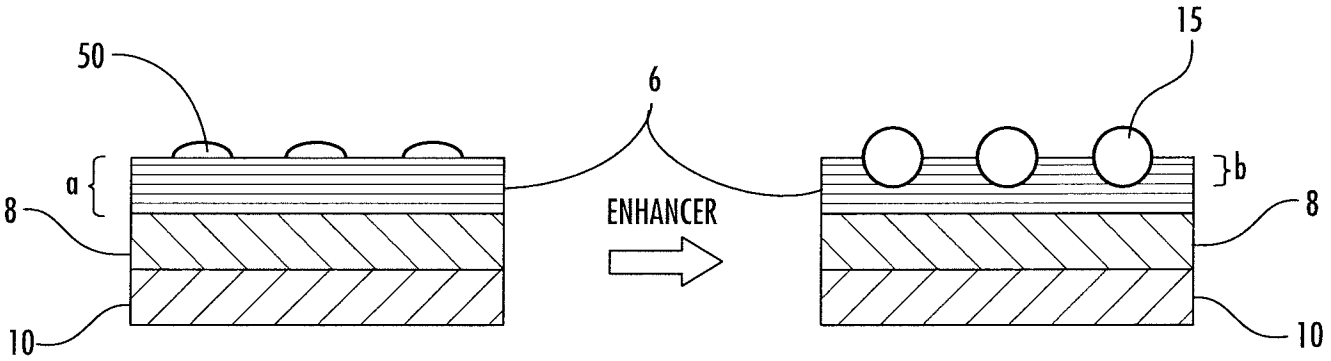
FIG. 7 illustrates the 'enhancer' ink compensating for an additional amount of ink penetration.

The software algorithm further monitors and traces each pixel of the image and ensures that the total amount of ink measured in vertical dimension is sufficient to wet and penetrate the ink receptive layer for hydrophilic tackiness. This process occurs independently from, but preferably simultaneously with, the x-y plane dimensional value requirements determination of the portion to be imaged. In FIG. 7, imaged portions 50 are formed by color inks that are not present in sufficient quantity to wet and activate the hydrophilic tackifier agent in the receptive layer 6. As a result, the imaged portions do not possess the required adhesive energy or force to achieve transfer to the final receiver substrate. This outcome may be a result of ink properties, and may occur, for example, where the image is a light color. An example is a faint yellow comprising 5% of the total ink printed. The light color ink of a portion of the image may be less than 1-micron in thickness (or 1 g/m2 in weight, approximately) at the transfer medium surface. To overcome the problem, the computer algorithm of the present invention detects or calculates the amount of ink that is present on portions of the image and compares the amount of ink that is present on those portions with the amount of ink present in the image layer that is required to achieve proper and permanent image formation of the image on the receiver substrate. The algorithm directs the printer to compensate for any inadequate quantity of ink for transfer present on the transfer medium, and the printer applies a required quantity of colorless 'enhancer' ink necessary to achieve an ink layer that will accomplish proper transfer of the portions of the image layer 15 (FIG. 7) as well as the entire image to the receiver substrate.

The thickness of the image 15 formed by the color ink on the transfer medium determines the required amount of colorless "enhancer' ink to achieve an image layer that will produce satisfactory adhesion upon transfer of the image. In one embodiment of the present invention, the minimum required thickness of the portion of the image layer that penetrates or saturates the ink receptive layer 6 of the transfer medium (b, FIG. 7), is one third of the thickness of the ink receptive layer 6 (a, FIG. 7) that is present over the release layer 8. For example, a transfer medium with a transfer coating thickness of 30 microns may need 10 microns of ink layer (color ink or color ink and colorless ink) to penetrate the ink receptive layer in any pixel to sufficiently wet, swell, and activate the hydrophilic tackifier agent to successfully separate the image from the main body of the transfer medium that is not imaged. If color ink is deposited to a thickness of 7 microns that has penetrated the ink receptive layer, the addition of 3 or more microns will generally be needed. If more than 10 microns of colorant comprising ink comprising colorants have penetrated the ink receptive layer, no colorless 'enhancer' ink may be required for those portions of the image.

The transfer method described herein does not require peeling imaged layers from a supporting base. Upon transfer, the ink-imaged area is separated from the non-imaged area of the transfer medium, allowing the imaged portion to be separated and fixed to the final receiver substrate. Unnecessary 'hand and feel" is eliminated since non-imaged layers are not transferred, a non-imaged polymer residues that tend to discolor over time are not present.

In most cases, a heat press may be used for the transfer process, with intimate contact between the imaged surface of the transfer medium and final receiver substrate. The heat press also promotes thermally induced colorant diffusion throughout the coating layers of the transfer medium. For instance, sublimation colorants may require a temperature close to 400° F. for an extended time period ranging from several seconds to several minutes. A chamber heat press capable of applying vacuum may be used to enhance the transfer efficiency.

The final substrate of the present invention may be a textile material, such as clothing or other fabrics. Natural textile materials such as cotton, jute, silk, and their co-produced fabric materials with polymeric components such as nylon, polyester, polyurethane, or polyolefin may also be used. Porous or semi-porous non-textile materials such as wood, bamboo, non-glazed ceramic, metallic surface, etc. are also among the preferred final substrates useful for the present invention. Pastel and dark substrates may also be used with white pigmented coating additives used in the ink receptive layer and/or clear polymeric layer.

FIG. 8 is a flow chart of a colorless 'enhancer' ink print driver process using a four-channel inkjet printer. A printer driver receives graphic design data (600) from graphic design application/software, and passes relevant RGB (Red, Green, Blue) color information for color matching, color separation and gamma-correction process (601), and converts RGB data into corresponding CMY (cyan, magenta, and yellow) values. Half-toning map (602) interpretation is then generated for each color ink channel so that a full color image can be generated using the three color inks in the form of half-toning realized by ink droplet deposit. Colorless 'enhancer' ink tracing and quantity (or saturation level) correction (603) further converts the CMY data into CMYE (Cyan, Magenta, Yellow, and Enhancer) before print data generation (604).

The following example algorithm illustrates how the printer driver or rendering software controls, monitors, and compensates by using the colorless 'enhancer' ink as explained in FIG. 8. Depending on the specific physical characteristics and coating thickness, variables used for tracing such as width and height, and the minimum and maximum ink deposit of each colored image portion may be calibrated, adjusted and applied for the application.

```
CMYE_Bitmap generateEnhancer(CMY_Bitmap
cmyBitmap, float minimumCoating, float maximumCoating,intsurround-
ingPixelRadius)
{
  CMYE_Bitmap cmyeBitmap;
  for(int x=0; x < cmyBitmap.width; x++ )
  {
      for(int y=0; y < cmyBitmap.height; y++ )
      {
        Point currentPosition(x, y);
        CMY_Pixel cmyPixel = cmyBitmap.pixel(currentPosition);
      CMYE_Pixel cmyePixel;
      cmyePixel.c = cmyPixel.c;
      cmyePixel.m = cmyPixel.m;
      cmyePixel.y = cmyPixel.y;
  float totalInk = getSurroundingPixelTotalInk(cmyBitmap,
currentPosition, surroundingPixelRadius);
     float area = 3.14 * power(surroundingPixelRadius, 2);
     cmyePixel.e = 1 - totalInk / area;
     cmyePixel.e = maximum (minimumCoating, cmyePixel.e);
     cmyePixel.e = minimum (maximumCoating, cmyePixel.e);
     cmyeBitmap.pixel(currentPosition) = cmyePixel;
    }
 }
 return cmyeBitmap;
}
```

The aqueous liquid ink interacts with the transfer medium and creates a tackiness or stickiness. The term tackiness or stickiness is used to refer to the wetting of the printed image against a solid dry body, and more specifically against the final receiver substrate when brought into contact with the image layer during transfer. The term is also used to refer to resistance to detachment of the printed image from the solid dry body, or final receiver substrate. The receiver substrate is often a porous material, such as textile or fabric surfaces.

Different methods can be used to determine the level of tackiness or stickiness required to adhere the image to the receiver substrate, including the finger test, ball, probe, or rolling ball tack tester, inkometer, tackoscope. For the purpose of this invention, a so called "stickiness index" may be used, as described in Japanese patent application JP2015995B1. Tackiness or stickiness with a stickiness index of not less than 30% dust particle adhesion at a temperature that is between ambient and the image transfer temperature is generally required to achieve sufficient wetting and adhesion between the imaged transfer medium and final receiver substrate.

The present invention is able to achieve high quality color imaging and image fastness that is resistant to fading from washing, perspiration and weathering, by using one or more binder materials in the transfer medium, including reactive binder materials. Gross coverage of the transfer medium with the binder materials is differentiated digitally from the coverage of the image to be printed upon it. The material or materials are applied to the receiver substrate over the general area to which the image layer formed by the inks is applied.

Imaged transfer media may experience evaporation of the liquids, including water, if exposed to open air upon completion of imaging. Evaporation may impact tackiness, inhibiting effective transfer of the image to the final substrates. Depending upon the specific coating formulation, coating thickness, ink formulation with various component ratios, ink printing or saturation level, as well as humidity of working environment, the evaporation rate will vary. Empirical observation may be used to determine the optimum time interval between completion of imaging and the transfer step. It is generally preferred to initiate the transfer process within 10 minutes of imaging the media, and more preferred to transfer the image within 5 minutes of completion of image formation.

Figure 1:
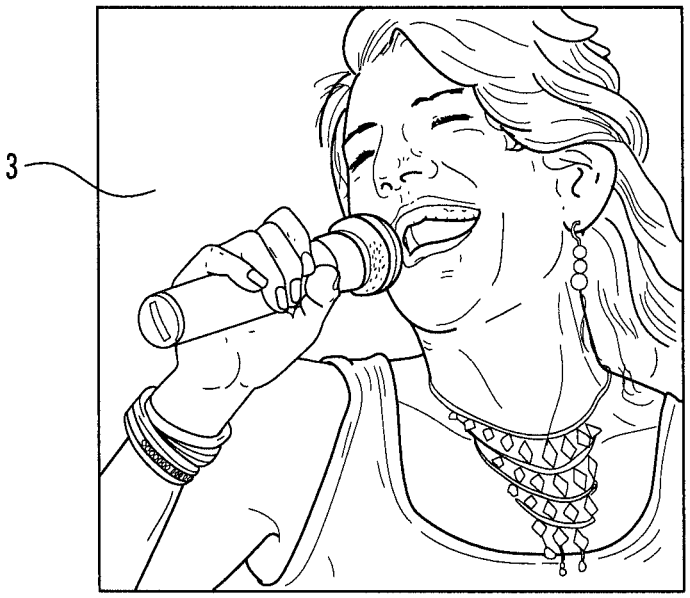
FIG. 1 illustrates an example of an image formed by an image-forming device on a blank substrate.
Figure 2:
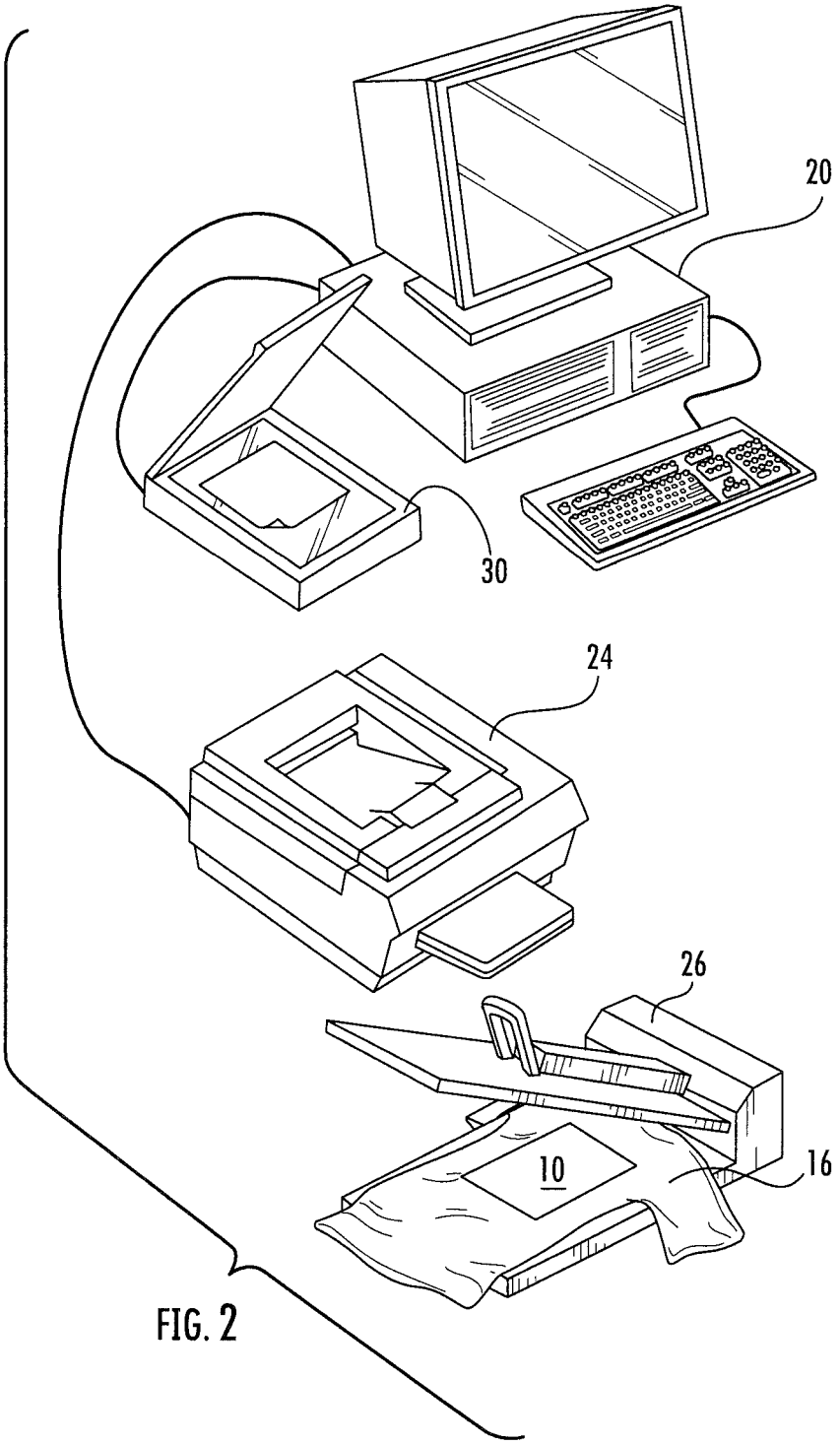
FIG. 2 demonstrates elements of digital printing and transfer hardware that are useful for practicing the invention.

The use of computer technology allows substantially instantaneous printing of images. FIG. 2. For example, video cameras or scanners 30 may be used to capture a color image on a computer 20. Images created or stored on a computer may be printed on command, without regard to run size. The image may be printed onto the substrate from the computer by any suitable printing means 24 capable of printing in multiple colors plus colorless 'enhancer' liquid inks, as described above.

Computers and digital printers are inexpensive, and transfers of photographs and computer generated images to substrates such as ceramics, textiles, including T-shirts 16, and other articles can be achieved. These transfers may be produced by end-users at home, as well as by commercial establishments. The image may be transferred by the application of heat and pressure as described. An iron for clothing, or a heat press 26 intended to accomplish such transfers, are examples of devices that may be used for heat transfer.

What is claimed is:

1. A transfer imaging method comprising the steps of:

forming an image by applying a liquid ink in the form of the image on a transfer medium, the transfer medium comprising a hydrophilic tackifier;

determining a portion of the image that is dimensionally insufficient to permanently adhere the image to the receiver substrate;

applying a colorless liquid ink comprising water to cover and surround the portion of the image that is dimensionally insufficient to permanently adhere the image to the receiver substrate, wherein the liquid ink and the colorless ink form an image layer comprising water;

applying heat to the image and transferring the image layer to a receiver substrate to form the image on the receiver substrate;

whereupon water from the image layer swells the image layer when heated and the hydrophilic tackifier becomes sufficiently tacky to permanently adhere the image to the receiver substrate.

2. The transfer imaging method described in claim 1, wherein the image is formed on the transfer medium by a printer that prints liquid inks, the printer comprising three print channels for color ink and a print channel for colorless ink.

3. The transfer imaging method described in claim 1, wherein the image is formed on the transfer medium by a printer that prints liquid inks, the printer comprising a print channel for colorless ink, wherein the print channel for colorless ink traces the portion of the image that is dimensionally insufficient to permanently adhere the image to the receiver substrate and applies the colorless liquid ink to surround the portion of the image that is dimensionally insufficient to permanently adhere the image to the receiver substrate.

4. The transfer imaging method described in claim 1, the portion of the image that is dimensionally insufficient to permanently adhere the image to the receiver substrate is determined by measuring the image along the x-y plane of the image.

5. The transfer imaging method described in claim 1, wherein a dimension of the image that is less than 75 microns as measured along the x-y plane of the image is dimensionally insufficient to permanently adhere the image to the receiver substrate.

6. The transfer imaging method described in claim 1, wherein the liquid ink comprises a thermally diffusible colorant.

7. The transfer imaging method described in claim 1, wherein the colorless ink increases penetration of the image layer into the hydrophilic tackifier of the transfer medium.

8. The transfer imaging method described in claim 1, wherein the transfer medium comprises an ink receptive layer that comprises the hydrophilic tackifier, and the image is formed on the ink receptive layer and the ink receptive layer receives the liquid ink and the colorless ink.

9. The transfer imaging method described in claim 1, wherein the transfer medium comprises a base sheet, a transfer layer, and an ink receptive layer that comprises the hydrophilic tackifier, and the image is formed on the ink receptive layer and the ink receptive layer receives the liquid ink and the colorless ink.

10. The transfer imaging method described in claim 1, wherein micropores are generated in the ink receptive layer during the step of applying heat to the image and transferring the image layer, and the micropores facilitate diffusion and migration of the liquid ink.

11. The transfer imaging method described in claim 1, further comprising the step of converting cyan, magenta and yellow data for the image into cyan, magenta, yellow, and colorless data before forming the image on the transfer medium.

12. The transfer imaging method described in claim 1, further comprising the step of determining the amount of ink applied to portions of the image that are dimensionally insufficient to permanently adhere the image to the receiver substrate.

13. The transfer imaging method described in claim 8, wherein the transfer medium further comprises a polymer layer.

14. The transfer imaging method described in claim 1, wherein the image is transferred from the transfer medium to the receiver substrate at a temperature above 150° C. and when the hydrophilic tackifier softens.

* * * * *